US006964476B2

(12) United States Patent
Okamoto

(10) Patent No.: US 6,964,476 B2
(45) Date of Patent: Nov. 15, 2005

(54) INK-JET RECORDING APPARATUS

(75) Inventor: Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/667,501

(22) Filed: Sep. 23, 2003

(65) Prior Publication Data

US 2004/0056922 A1 Mar. 25, 2004

(30) Foreign Application Priority Data

Sep. 25, 2002 (JP) ..... 2002-278437

(51) Int. Cl.[7] ..... B41J 25/308
(52) U.S. Cl. ..... 347/104; 347/8; 400/59
(58) Field of Search ..... 347/8, 104; 400/59

(56) References Cited

U.S. PATENT DOCUMENTS 4,268,177 A * 5/1981 Veale ..... 400/55
4,463,359 A * 7/1984 Ayata et al. ..... 347/56
5,678,936 A * 10/1997 Hino ..... 400/55
5,700,095 A * 12/1997 Sugiyama ..... 400/55
6,000,775 A * 12/1999 Muraki ..... 347/8
6,315,468 B2 * 11/2001 Kishida et al. ..... 400/55
6,629,787 B2 * 10/2003 Lee et al. ..... 400/59

FOREIGN PATENT DOCUMENTS

JP A 05-330164 12/1993
JP A 07-32680 2/1995
JP B2 2797637 7/1998

* cited by examiner

*Primary Examiner*—Andrew H. Hirshfeld
*Assistant Examiner*—Jill E. Culler
(74) *Attorney, Agent, or Firm*—Oliff & Berridge, PLC

(57) ABSTRACT

An ink-jet recording apparatus comprises an ink-jet head having an ink ejection surface on which a plurality of nozzles are arrayed; a medium carrier forming a carrying surface on which a record medium is carried; a carriage mounted with the ink-jet head such that the ink ejection surface confronts the carrying surface; a carriage drive mechanism including a plurality of parallel guide rods supporting the carriage and extending across the direction where the record medium is carried by the medium carrier, the carriage drive mechanism reciprocating the carriage along the guide rods; and a guide shift mechanism for shifting the plurality of guide rods in a direction where the gap between the ink ejection surface and the carrying surface varies.

5 Claims, 7 Drawing Sheets

INK-JET RECORDING APPARATUS

BACKGROUND OF THE INVENTION

1. Field of the Invention

The present invention relates to an ink-jet recording apparatus including an ink-jet head for ejecting ink droplets onto a record medium.

2. Description of Related Art

A plotter is known that performs recording with a pen that is moved by pulling via a belt a carriage mounted with the pen. Supporting the carriage by two guide rails is disclosed in Japanese Patent No. 2797637 as a technique for reciprocating the carriage in one direction in such a plotter. Application of this technique to a serial printing-type ink-jet printer results in a structure in which the carriage mounted with an ink-jet head is supported by two guide rods and simultaneously reciprocates along the guide rails. In this case, the distance from the ink ejection surface of the ink-jet head to the record medium carrying surface is invariable.

However, a record medium for use in the ink-jet printer may have various thicknesses. Therefore, the distance from the ink ejection surface to the record medium surface confronting the ink ejection surface varies depending on the thickness of a record medium. For this reason, when record media having different thickness are used, the printing quality changes depending on the thickness of the printed medium, leading to unstable printing quality.

SUMMARY OF THE INVENTION

It is a primary object of the present invention to provide an ink-jet recording apparatus capable of printing with a high quality irrespective of the thickness of a record medium.

According to an aspect of the present invention, the ink-jet recording apparatus comprises an ink-jet head that has an ink ejection surface on which a plurality of nozzles are arrayed; a medium carrier that forms a carrying surface on which a record medium is carried; a carriage mounted with the ink-jet head such that the ink ejection surface confronts the carrying surface; a carriage drive mechanism that includes a plurality of parallel guide rods supporting the carriage and extending across the direction where the record medium is carried by the medium carrier, the carriage drive mechanism reciprocating the carriage along the guide rods; and a guide shift mechanism that shifts the plurality of guide rods in a direction where the gap between the ink ejection surface and the carrying surface varies.

This enables the distance from the ink ejection surface to the record medium surface confronting the ink ejection surface to be kept constant. A high-quality printing can thus be effected on various record media having different thickness. Even when a record medium having a relatively large thickness is used, dirt on the record medium or jamming can be restrained from occurring since the record medium is hard to rub against or to get caught by the ink ejection surface of the ink-jet head.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
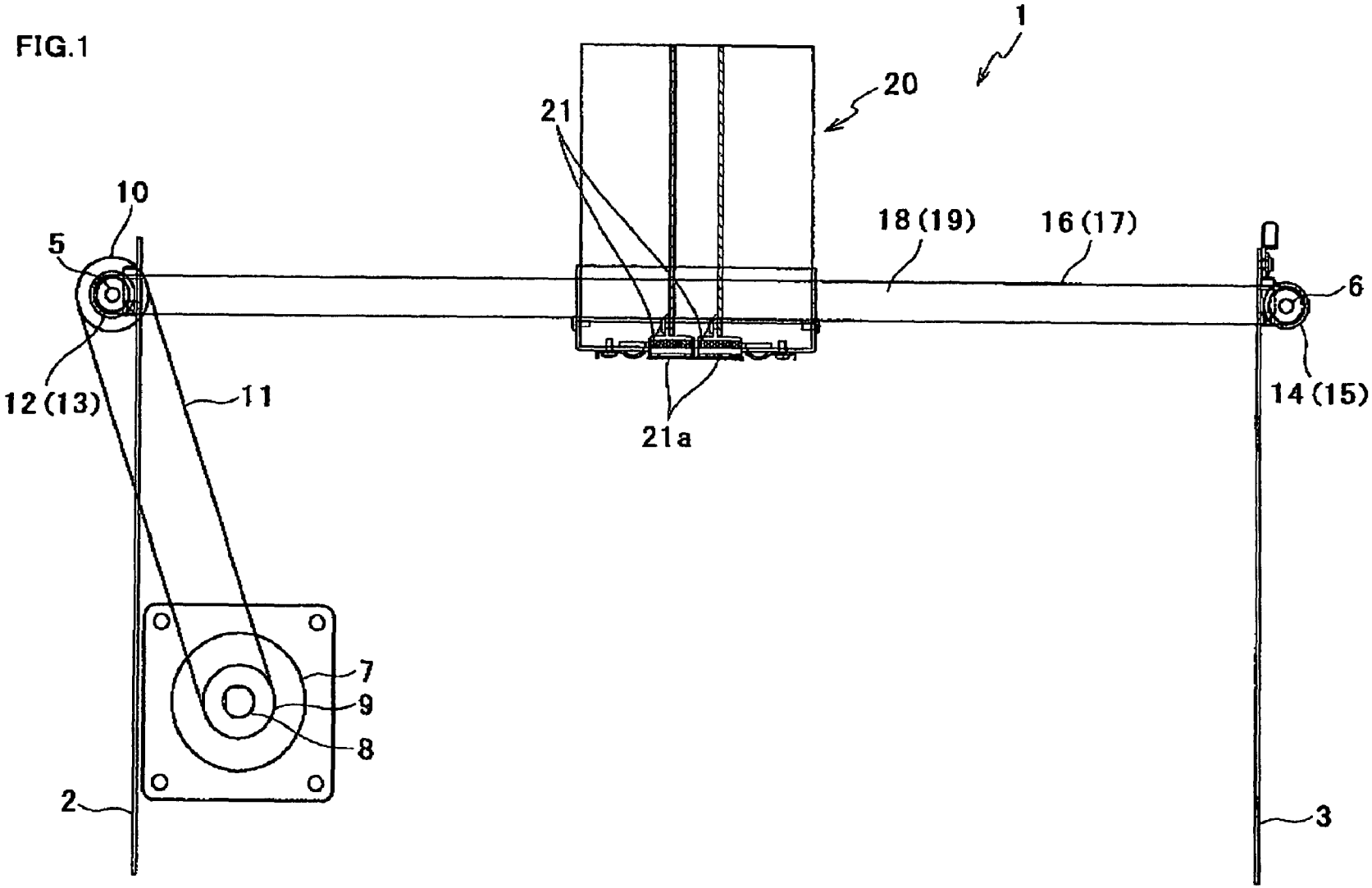
FIG. 1 is a schematic front elevational view of an ink-jet printer in accordance with an embodiment of the present invention.
Figure 2:
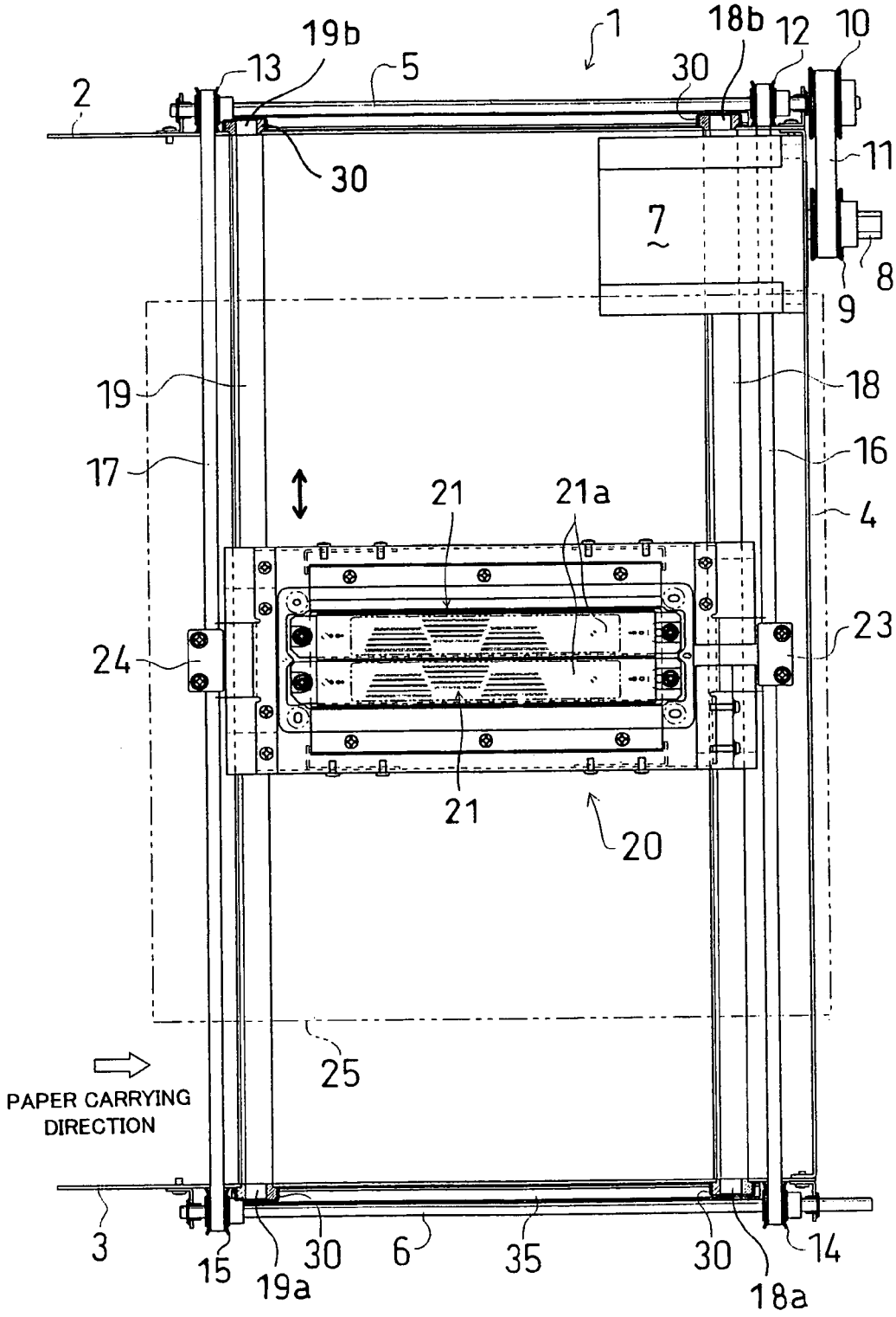
FIG. 2 is a bottom plan view of the ink-jet printer shown in FIG. 1.

Referring first to FIGS. 1 and 2, an ink-jet printer 1 in accordance with an embodiment of the present invention is of a serial printing type having a carriage 20 that reciprocates transversely in FIG. 1. The carriage 20 provides a support for two ink-jet heads 21 such that their ink ejection surfaces 21*a* are horizontal. On the ink ejection surface 21*a*, a multiplicity of nozzles are arrayed in a matrix. The ink-jet head 21 is of a rectangular geometry whose longitudinal direction is orthogonal to the direction in which the carriage 20 moves. This ink-jet head 21 has a length of, e.g., about of 10 cm or longer and is elongated as compared with ones having in-line nozzles that are arrayed in one or two rows. In FIG. 1, a medium carrier is not shown such as a carrying belt 25 which will be described later.

Figure 3:
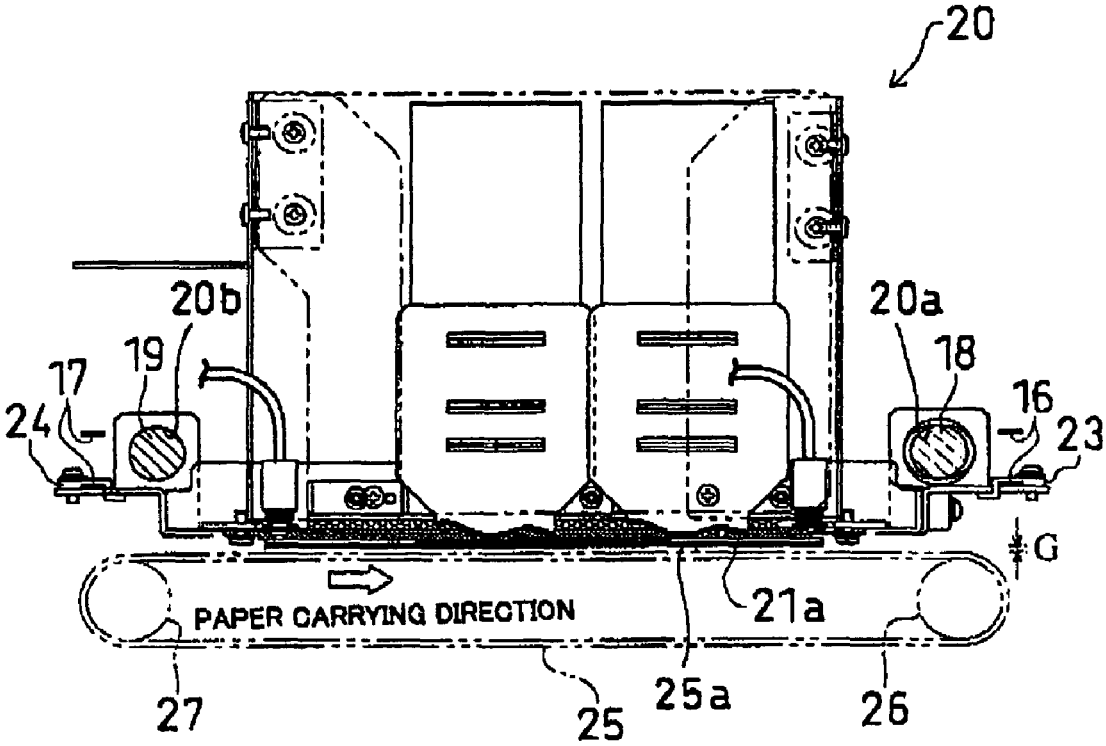
FIG. 3 is a side elevational view of a carriage and its vicinity included in the ink-jet printer shown in FIG. 1.

As shown in FIG. 3, the carriage 20 has circular in section bores 20*a* and 20*b* disposed near its opposite ends along the longitudinal direction of the ink-jet heads 21. The bores 20*a* and 20*b* receive cylindrical guide rods 18 and 19 in such a manner as to slidably support the carriage 20. The guide rods 18 and 19 are supported at their respective opposite ends by side frames 2 and 3, respectively, that are vertical plates extending parallel to each other outside the carrying belt 25. As will be described later, the guide rods 18 and 19 are supported by the side frames 2 and 3 such that the height of the guide rods is adjustable, The side frames 2 and 3 are coupled to each other via a front frame 4.

Outside the side frame 2 is supported a carriage drive shaft 5 level with the guide rods 18 and 19 such that the carriage drive shaft 5 is orthogonal to the guide rods 18 and 19. Outside the side frame 3 is supported a coupling shaft 6 level with the guide rods 18 and 19 such that the coupling shaft 6 is orthogonal to the guide rods 18 and 19. That is, the two shafts 5 and 6 are arranged parallel to the direction (hereinafter, referred to simply as "paper carrying direction") in which paper, a record medium is carried.

The front frame 4 is mounted with a carriage drive motor 7 below the guide rods 18 and 19. A pulley 9 is fixedly fitted around an output shaft 8 of the carriage drive motor 7. An endless belt 11 is wrapped around the pulley 9 and a pulley 10 fixedly fitted around one end of the carriage drive shaft 5 so that the carriage drive shaft 5 rotates together with rotation of the output shaft 8.

The carriage drive shaft 5 is fitted with two toothed driving pulleys 12 and 13. The coupling shaft 6 is also fitted with toothed driven pulleys 14 and 15 positioned corresponding to the driving pulleys 12 and 13, respectively. Carriage driving belts 16 and 17 in the form of endless belts are respectively wrapped around the driving pulley 12 and the driven pulley 14 and around the driving pulley 13 and the driven pulley 15. The carriage driving belts 16 and 17 extend level with and parallel to the guide rods 18 and 19, respectively. All of the four pulleys 12, 13, 14 and 15 are of the same external diameter. Thus, by driving the carriage drive motor 7 forwardly or reversely, it is possible to rotationally drive the carriage driving belts 16 and 17 at the same speed in both directions, clockwise and counterclockwise directions of FIG. 1.

As seen in FIGS. 2 and 3, the carriage 20 is provided with fixed portions 23 and 24 disposed outside the bores 20*a* and 20*b*, respectively. The carriage 20 is secured via the fixed portions 23 and 24 to the carriage driving belts 16 and 17, respectively. Thus, by driving the carriage drive motor 7 forwardly or reversely, it is possible to reciprocate the carriage 20 in the direction (the direction of a thick arrow of FIG. 2) along the guide rods 18 and 19. In this manner, use of the two guide rods 18 and 19 allows the carriage 20 supporting the elongated ink-jet heads 21 to travel stably.

As indicated by long dashed double-short dashed lines in FIGS. 2 and 3, at positions confronting ink ejection surfaces of the ink-jet heads 21 is disposed a carrying surface 25*a* of the carrying belt 25 in the form of an endless belt for carrying the record medium in the direction orthogonal to the guide rods 18 and 19. The carrying belt 25 is wrapped around two rollers 26 and 27. A driving force from a motor (not shown) is transmitted to one roller 26 so that while keeping a record medium on the carrying surface 25*a* of the carrying belt 25 the record medium can be carried along the carrying surface 25*a* in the direction of outlined arrows depicted in FIGS. 2 and 3.

Figure 4:
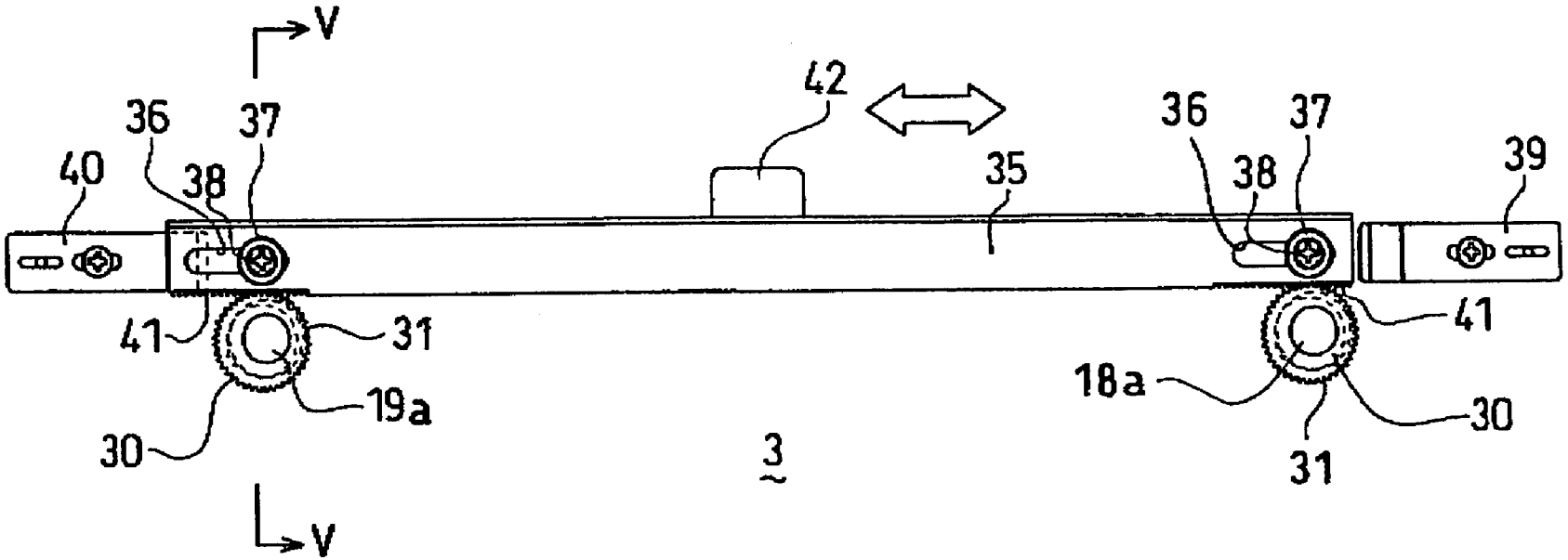
FIG. 4 is a partial side view of the ink-jet printer shown in FIG. 1.
Figure 5:
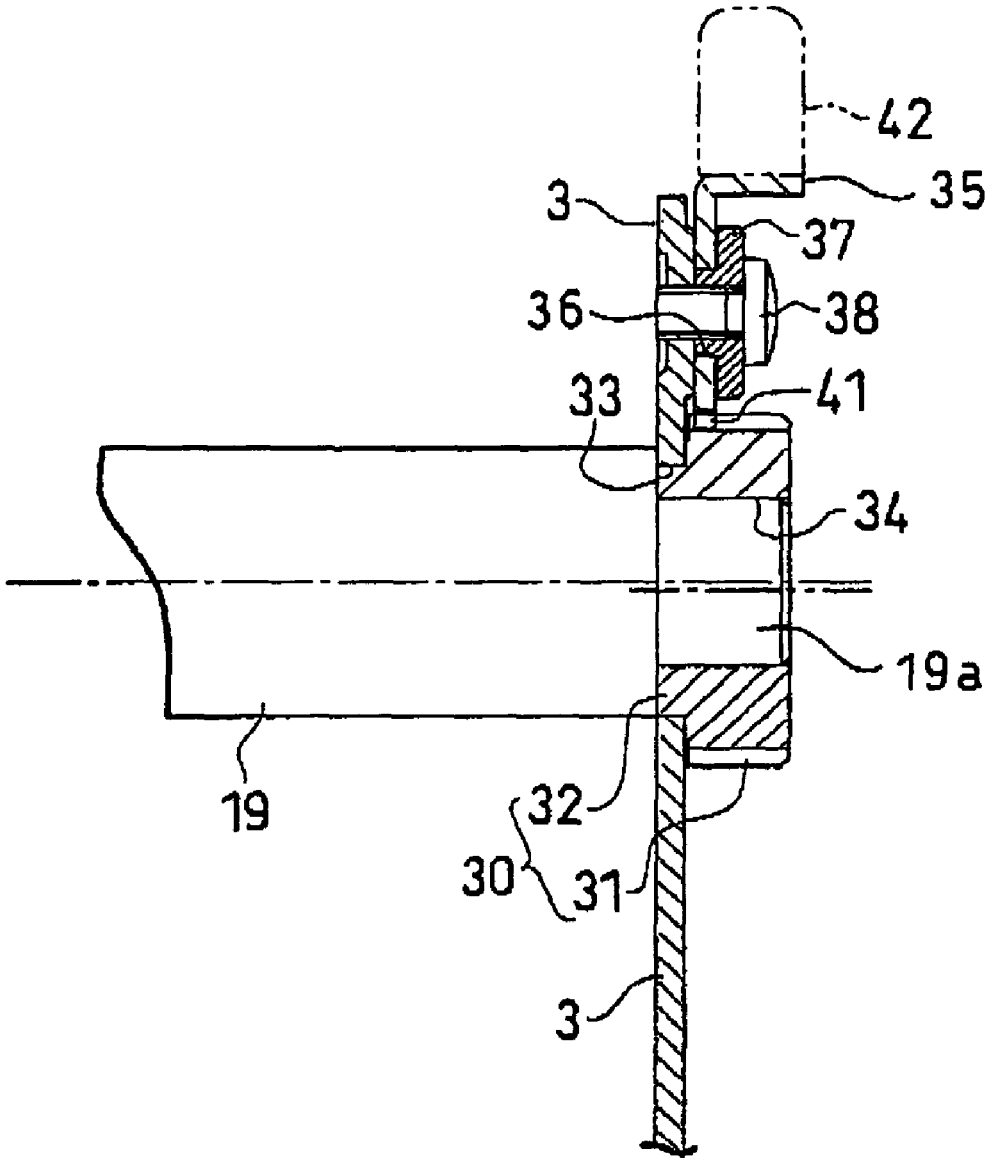
FIG. 5 is a cross-sectional view of a guide rod in the vicinity of its one end, taken along line V—V of FIG. 4.

A structure for supporting the guide rods 18 and 19 will then be described with further reference to FIGS. 4 and 5. As shown in FIG. 2, the guide rods 18 and 19 are provided at their respective opposite ends with cylindrical inserting portions 18*a*, 18*b* and 19*a*, 19*b*, respectively, that are smaller in external diameter than parts inside the inserting portions. The inserting portions 18*a*, 18*b*, 19*a* and 19*b* are coaxial with the parts inside the inserting portions.

As shown in FIG. 5, the inserting portion 19*a* is inserted into a bearing hole 33, having a diameter larger than the external diameter of the inserting portion 19*a* and smaller than the external diameter of the guide rod 19, formed in the side frame 3, in such a manner that the inserting portion 19*a* protrudes in its entirety from the side frame 3 to the exterior. The inserting portion 19*a* protruding from the bearing hole 33 is press-fitted into a support hole 34 formed in a gear 30 acting as a rotator. The center of the support hole 34 is offset from the rotational center of the gear 30.

The gear 30 includes a toothed portion 31 having teeth formed around its circumference, and a boss 32 axially protruding from the toothed portion 31. The boss 32 is positioned between the inner peripheral surface of the bearing hole 33 formed in the side frame 3 and the outer peripheral surface of the inserting portion 19*a*. The other inserting portions 18*a*, and 18*b*, 19*b* are also supported via the gears 30 by the side frames 3 and 2, respectively, similar to the case of the inserting portion 19*a* supported by the side frame 3.

Outside the side frame 3 above the gear 30, as shown in FIGS. 4 and 5, the side frame 3 provides a support for an L-shaped bar 35 elongated in the paper carrying direction. The L-shaped bar 35 is of an L-shaped section and has at its opposite ends two elongated holes 36 facing toward the paper carrying direction. Each elongated hole 36 receives a boss 37 having a slightly smaller external diameter than the width of the elongated hole 36. A screw 38 fitted into the boss 37 is threadedly secured to the side frame 3 such that the L-shaped bar 35 can be displaced by a length of the elongated hole 36 in the direction along the paper carrying direction with respect to the side frame 3. Stoppers 39 and 40 are disposed at both sides in the direction where the L-shaped bar 35 is displaceable, the stopper 39 and 40 serving to regulate the displacement of the L-shaped bar 35 to thereby define the range of displacement of the L-shaped bar 35.

The undersurface near both extremities of the L-shaped bar 35 is formed with a rack 41 extending over a longer range than the elongated hole 36. The rack 41 engages with the toothed portion 31 formed around the circumference of the gear 30. As a result, the gear 30 fitted to the inserting portion 18*a* and the gear 30 fitted to inserting portion 19*a* are coupled together by way of the L-shaped bar 35. In other words, transverse displacement of the L-shaped bar 35 causes corotation of the two gears 30. It is to be noted that upon the coupling of these two gears 30, adjustment is made such that the rotational phases of the support holes 34 coincide.

The L-shaped bar 35 is provided at or near the center in the longitudinal direction thereof with an upwardly protruding, substantially cylindrical knob 42. Thus, arrangement is such that the L-shaped bar 35 can simply be slid along its longitudinal direction by holding the knob 42 with one hand and moving it transversely.

In this embodiment, the side frame 2 is not provided with any member similar to the L-shaped bar 35. Accordingly, the gear 30 fitted to the inserting portion 18*b* is not coupled to the gear 30 fitted to the inserting portion 19*b*. This means that these two gears 30 may be a mere eccentric cam having no toothed portion around its outer peripheral surface. In a case where the side frame 2 is fitted with a similar member to the L-shaped bar 35, however, that member may couple together the gear 30 fitted to the inserting portion 18*b* and the gear 30 fitted to the inserting portion 19*b*.

Figure 6:
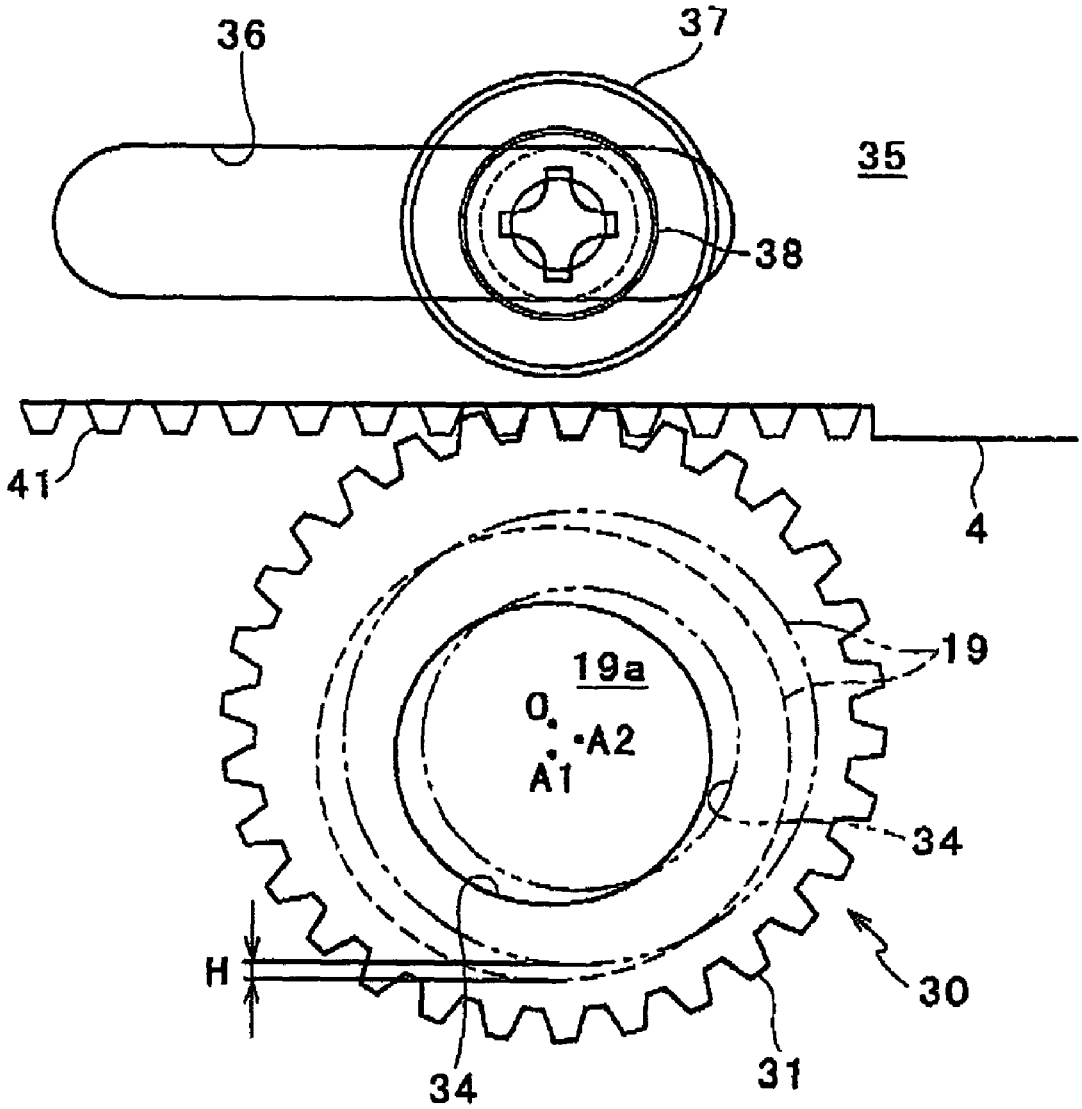
FIG. 6 is an enlarged, fragmentary side view of a gear and its vicinity, depicted in FIG. 4.
Figure 7:
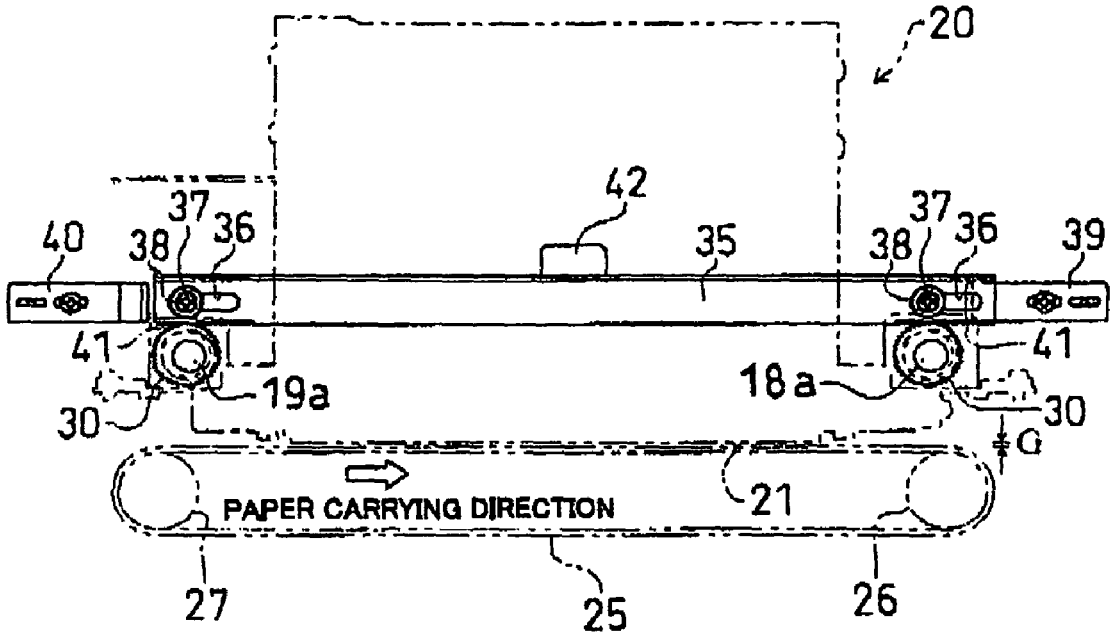
FIG. 7 is a side elevational view of the ink-jet printer shown in FIG. 1.

By virtue of employment of the above structure for supporting the guide rods 18 and 19, it is possible to vary the distance between the ink ejection surface 21*a* of he ink-jet head 21 and the carrying surface 25*a* through the slide of L-shaped bar 35. Reference is then made to FIGS. 6 and 7 to describe the action when operating the knob 42 fitted to the L-shaped bar 35.

As shown in FIG. 6 which is an enlarged, fragmentary side view of the inserting portion 19*a* and its vicinity of FIG. 4, the center A1 of the inserting portion 19*a* and of the guide rod 19 is offset from the center O of the gear center 30. Therefore, when the gear 30 rotates as a result of sliding of the L-shaped bar 35, the center of the inserting portion 19*a* and of the guide rod 19 moves from A1 to A2. This allows the guide rod 19 to move from the position depicted by a dashed line to the position depicted by a long dashed double-short dashed line. The movement changes the position of the guide rod 19 in the amount of displacement in height H. The guide rod 18 coupled to the guide rod 19 by way of the two gears 30 and the L-shaped bar 35 also moves by the same distance as the distance through which the guide rod 19 moves, in the same direction as the direction in which the guide rod 19 moves. For this reason, the height of the carriage 20 supported by the two guide rods 18 and 19 varies by the amount of displacement in height H of the guide rods 18 and 19. It is thus possible to vary the distance, the gap G shown in FIG. 7, between the ink ejection surface 21*a* of the ink-jet head 21 and the carrying surface 25*a*.

Referring finally to FIG. 7, a status is shown when the knob 42 of the L-shaped bar 35 is moved from right to left.

In the state of FIG. 7, the knob 42 is at its right-hand position. At that time, the gap, designated at G in FIG. 7, between the ink ejection surface 21*a* and the carrying surface 25*a* is relatively narrow, When the knob 42 is moved to its left-hand position from this state, the L-shaped bar 35 also moves jointly therewith so that the rack 41 formed on the L-shaped bar 35 causes simultaneous rotations of the two gears 30. Then, as described above, the rotations of the gears 30 cause simultaneous variances the amount of displacement in height H of the two guide rods 18 and 19. Since the carriage 20 is supported by the two guide rods 18 and 19, the gap G becomes larger by the same amount as the amount of displacement in height H of the guide rods 18 and 19.

Description will then be made briefly of printing action on the record medium in the ink-jet printer 1 thus configured. In the initial state, the knob 42 is operated in advance to adjust the distance between the ink ejection surface 21*a* and the carrying surface 25*a* so that the distance from the ink ejection surface 21*a* to the surface of the record medium is kept at a predetermined distance irrespective of the thickness of the record medium to be printed. When the printing action is started, a record medium fed from a paper feed cassette (not shown) lying on the left hand in FIGS. 2 and 3 to the carrying belt 25 passes, together with rotation of the carrying belt 25, through the gap G formed between the undersurface, i.e., the ink ejection surface 21*a* of the ink-jet head 21 and the top surface, i.e., the carrying surface 25*a* of the carrying belt 25. Simultaneous with this, the carriage 20 travels reciprocatingly in the width direction (the direction of the thick arrow of FIG. 2) of the record medium while ejecting ink droplets from nozzles formed on the ink ejection surface 21*a*. As a result, a desired image is formed on the top surface of the record medium.

As set forth hereinabove, according to this embodiment, the gap between the ink ejection surface 21*a* and the carrying surface 25*a* can be adjusted with the parallelism therebetween maintained. It is thus possible to keep the distance between the ink ejection surface 21*a* and the record medium surface at a certain level value by increasing the gap between the ink ejection surface 21*a* and the carrying surface 25*a* for a record medium having a large thickness but by reducing the gap between the ink ejection surface 21*a* and the carrying surface 25*a* for a record medium having a small thickness, This enables printing with a high printing quality to be effected on any record medium having a different thickness such as a mere one-ply record medium or a two-ply envelope. Even when using a record medium having a considerably large thickness, the record medium can be prevented from rubbing against or getting caught by the ink ejection surface 21*a* of the ink-jet head 21. It is accordingly possible to reduce the occurrence of dirt on the record medium or jamming to a large extent.

The ink-jet recording apparatus of this embodiment is excellent in practical use since the gap adjustment is possible between the ink ejection surface 21*a* and the carrying surface 25*a* through a simple structure where the guide rods 18 and 19 are supported at eccentric positions on the gears 30. In addition, the ink-jet recording apparatus of this embodiment is excellent in operability since the L-shaped bar 35 only needs to be slid. Formation of the rack 41 on the L-shaped bar 35 allows the gear 30 to rotate through the engagement of the rack 41 with the toothed portion 31 of the gear 30, contributing to enhancement of reliability.

Furthermore, its operation becomes easier due to the L-shaped bar 35 capable of simultaneously rotating the two gears 30. Provision of the knob 42 on the L-shaped bar 35 facilitates user's operation. Since the guide rods 16 and 19 are supported at their respective opposite ends by the corresponding gears 30, the guide rods 18 and 19 can hardly vary in height, contributing to excellent height stability.

In addition, since the carriage 20 is movable by the carriage driving belts 16 and 17 running parallel to the guide rods 18 and 19, it can hardly occur that the gap between the ink ejection surface 21*a* and the carrying surface 25*a* varies depending on the position of the carriage 20.

Although the above embodiment has included the belt 25 as a carrier for carrying a record medium, the carrying means is not limited thereto but may be a mechanism in which the record medium is carried while being nipped by rollers or roller pairs having cylindrical surfaces as their carrying surfaces. The L-shaped bar 35 need not necessarily be provided for each gear 30 to couple the two gears 30 together.

The mechanism for moving the guide rods can variously be modified without being limited to the above mechanism. The record medium can be in the form of paper, plastic film, etc. It is only essential that the record medium is a sheet-like medium having flexibility and allowing images to be recorded on its one surface by the ink-jet heads. The coupling of the two gears 30 may be achieved by wrapping an endless belt around the two gears 30, instead of using the L-shaped bar 35. Although in the above embodiments the present invention has been described by way of the ink-jet printer in an example, the present invention is applicable equally to other printing equipment such as facsimiles or copiers mounted with ink-jet heads.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

an ink-jet head that has an ink ejection surface on which a plurality of nozzles are arrayed;

a medium carrier that forms a carrying surface on which a record medium is carried;

a carriage that mounts the ink-jet head such that the ink ejection surface confronts the carrying surface;

a carriage drive mechanism that includes a plurality of parallel guide rods supporting the carriage and extending across a direction where the record medium is carried by the medium carrier, the carriage drive mechanism reciprocating the carriage along the guide rods; and a guide shift mechanism that shifts the plurality of guide rods in a direction where a gap between the ink ejection surface and the carrying surface varies, the guide shift mechanism including:

gears, each gear supporting one of the guide rods at an eccentric position and having a center of rotation at a position different from the eccentric position, a rotation of the gears causing the guide rods to shift; and a slidable torquer having a rack directly engaged with the gears, and imparting a torque to the gears to rotate the gears.

2. The ink-jet recording apparatus according to claim 1, wherein the torquer is provided with a knob.

3. The ink-jet recording apparatus according to claim 1, wherein each guide rod is supported by two of the gears.

4. The ink-jet recording apparatus according to claim 1, wherein the carriage drive mechanism includes:

pairs of pulleys each having a rotational axis orthogonal to the guide rods, two of the pulleys making up each pair being separated from each other along the guide rods; and a plurality of carriage drive belts each wrapped around the pair of pulleys.

5. An ink-jet recording apparatus comprising:

an ink-jet head that has an ink ejection surface on which a plurality of nozzles are arrayed;

a medium carrier that forms a carrying surface on which a record medium is carried;

a carriage that holds the ink-jet head such that the ink ejection surface confronts the carrying surface; and a guide shift mechanism that includes a pair of parallel guide rods supporting the carriage, a pair of gears each supporting one end of one of the guide rods at an eccentric position, a pair of eccentric cams each disposed at the other end of one of the guide rods and having the same diameter as that of the gears, and a slidable torquer having a rack directly engaged with the pair of the gears, and imparting a torque to the gears to rotate the gears, so that the pair of guide rods is shifted to thereby adjust the gap between the ink ejection surface and the carrying surface.

* * * * *